United States Patent [19]

Chombert et al.

[11] Patent Number: 4,880,089

[45] Date of Patent: Nov. 14, 1989

[54] CONVERTIBLE VALET BAG

[76] Inventors: Dominique Chombert, 82, rue de la Faisanderie, Paris, France; Francoise Hubert-Sternback, 9 Place Saint Augustin, 75008 Paris, France

[21] Appl. No.: 206,545

[22] Filed: Jun. 14, 1988

[30] Foreign Application Priority Data

May 20, 1988 [EP] European Pat. Off. ..... 88401237.8

[51] Int. Cl.[4] ..... A45C 7/00; A45C 13/04; A45C 13/24

[52] U.S. Cl. ..... 190/18 R; 190/14; 190/101; 190/107; 190/120; 190/122; 206/278; 206/280; 248/156; 248/97

[58] Field of Search ..... 190/14, 15 R, 18 R, 190/18 A, 101, 107, 903, 103, 104, 122; 206/278, 290, 280; 288/156; 248/97

[56] References Cited

U.S. PATENT DOCUMENTS

| | | | |
|---|---|---|---|
| 2,476,932 | 7/1949 | Tucker | 190/15 R X |
| 2,565,969 | 8/1951 | Judson | 190/15 R |
| 2,682,904 | 7/1954 | Divine | 248/156 X |
| 2,924,338 | 2/1960 | Sharp | 248/156 X |
| 3,141,536 | 7/1964 | Fulton | 190/903 X |
| 3,552,529 | 1/1971 | Marshall | 190/107 |
| 3,613,843 | 10/1971 | Davis | 190/903 X |
| 3,773,286 | 11/1973 | Govoni et al. | 248/156 X |
| 4,454,824 | 6/1984 | Wood | 248/156 X |
| 4,502,576 | 3/1985 | Reardon | 190/18 R |
| 4,538,709 | 9/1985 | Williams et al. | 190/12 A |

FOREIGN PATENT DOCUMENTS

| | | | |
|---|---|---|---|
| 1956036 | 7/1971 | Fed. Rep. of Germany | 190/18 A |
| 438318 | 3/1912 | France | 190/14 |
| 2355475 | 1/1978 | France | 190/101 |
| 55303 | 6/1968 | Poland | 206/290 |

*Primary Examiner*—Sue A. Weaver

*Attorney, Agent, or Firm*—Seidel, Gonda, Lavorgna & Monaco

[57] ABSTRACT

A convertible valet bag, characterized in that it is made from a generally rectangular bag opened at the top and fitted, at this level, with a holding means, as well as a supporting means which is movable between a resting position in which it is totally retracted within the bag and a working position in which it acts as a support to allow the bag to stand in a generally upright position.

9 Claims, 3 Drawing Sheets

CONVERTIBLE VALET BAG

The present invention concerns a convertible valet bag; this bag can, of course, have any use whatsoever, particularly as a travel bag or beach bag.

All surveys concerning the types of holiday preferred by Europeans have shown that the sun and the sea come top, largely, and that "lounging" on a sunlit beach, interspersed with dips in a warm sea, jogging or other open air sport, constitute the ideal holiday for the majority.

To make the best use of the beach and perfect their suntan, holiday-makers try to spend the maximum number of hours there; for that, it is necessary to take various indispensable things there from terry towels and a change of swimming costume to magazines, suntan products, drinks, sandwiches, etc.

To this end, it is imperative to allow for large bags to contain the above-mentioned items, and also holiday-makers "street clothes".

Then again, bags of the "hold-all" type which are used at present are not totally satisfactory given that they are not very stable once put down on the beach and risk getting filled with sand, which is prejudicial to their contents and it is impossible to pack relatively bulky or fragile items of clothing such as jackets and trousers without creasing them.

The present invention intends to remedy these inconveniences by proposing a bag able to contain all the items necessary to the holiday-maker for a day at the beach without the risk of contact with the sand, and which, moreover, allows the user to avoid having to put clothes directly onto the sand and then allows him to return home being still clean and impeccable.

To this end, the invention concerns a convertible valet bag characterised in that it is made up of a preferably rectangular bag open at the top and fitted, at this level, with holding means, particularly handles, as well as with fixing means moveable between a resting position in which they are totally retracted within the bag and a working position in which they are extended outwards in order to act as a support, particularly to hang clothes on while allowing the bag to stand upright on the ground.

Thanks to this arrangement, the bag of the invention makes a dumb waiter when in its working position; the user can, very easily, hang his clothes (jacket, skirt, trousers . . . ) on the stand without risk of creasing them.

In order to maximise the use of the bag's volume, it is particularly advantageous to place the fixing means, not directly in this bag, but in a pocket solidly attached thereto, or even removably fixed to it, particularly by means of press studs so as to permit the user, in some cases, to make use of the bag without having to carry the fixing means; this separation of the bag from the pocket lets the user, in any case, have free access to the inside of the bag.

Of course, the bag of the invention can have any arrangement whatsoever without departing from the scope of the invention: the bag can for example advantageously include an external gusset to increase its capacity, or indeed small internal or external auxiliary pockets able to hold more fragile items (watch, jewellery . . . ).

The bag can moreover be of any material whatsoever particularly fabric, synthetic material or even leather without departing from the scope of the invention; given that the inside of the bag is expected to hold damp terry towels or even wet clothing, it is however advantageous to line the interior with an impermeable coating.

Furthermore, in order that the bag according to the invention may be used in a satisfactory way, it is imperative that the fixing means can be completely retracted into the pocket in the resting position, so that the user, notably holiday-makers can carry it holding it by its handles in the usual way, or even by means of a shoulder strap fixed to the bag.

According to another characteristic of the invention, the fixing means are comprised of a frame, particularly removable, resting on the bottom of the pocket and co-operating, on one hand, with a rigid suspension body in the shape of an inverted U comprising two side arms, particularly telescopic, as well as a central crossbar carrying a coat-hanger, particularly articulated, and, on the other hand, with a removable support body also in the shape of an inverted U and comprising a central beam as well as two lateral pegs ending in two points able to project outwards through two openings provided for this purpose in the base of the pocket and to be driven into the ground, particularly into the sand, the central crossbar of the suspension body as well as the central beam of the support body acting as operating handles to change the bag from the resting position to the working position or vice versa.

The above-mentioned fixing means can be in any rigid material whatsoever: metal (aluminum), synthetic material or even wood . . . It is in any case imperative that they form a sufficiently light assembly to be easily carried with the bag in the resting position.

The side arms of the suspension body are usually telescopic; in some particular configurations, they may nevertheless comprise hinged articulations without thereby departing from the scope of the invention.

Moreover, according to the invention, the coat-hanger is, usually, made up of an independent articulated element on the central crossbar of the suspension body on its upper part, so as to facilitate the setting up or the holding of clothing or other items; it is, however, equally possible, in certain simplified embodiments, to simply bend the above-mentioned central crossbar so that this corresponds to the shape of the classic type of hanger.

In any case, in order to move the bag from its working position to its resting position, it suffices for the user to pull in one direction or another on the crossbar and the central beam.

According to another characteristic of the invention, the frame comprises a principal bar having, perpendicularly on one hand, at its ends, two tubular branches forming sheaths for the side arms of the suspension body and, on the other hand and in the immediate vicinity of its tubular branches, two guide sleeves perforated right through, co-operating with the lateral pegs of the support body and permitting their movement towards the outside of the bag in its working position.

To allow the utilisation of the above-mentioned bag, it is imperative to equip the fixing means with locking means, on one hand, for the suspension body in the working position and, on the other hand, for the support body in the resting position, so as to keep the points of the lateral pegs safely inside the pocket, without the risk of downward displacement.

To this end and according to another characteristic of the invention, the side arms of the suspension body co-operate with a pawl allowing the suspension body to remain in the working position. This pawl is advantageously made up of an element resiliently biased inside the side arms and able to project beyond the external surface through an opening provided for that reason to maintain and lock the suspension body in the working position. To replace this body in the resting position, it suffices for the user to press the pawls to unlock the system then to push down the central crossbar.

Moreover, the tubular branches of the frame are fitted on their outer periphery with two lugs forming abutments to keep the support body inside the pocket in the resting position.

According to this arrangement, the support body is held at the level of the central beam; to move the support body to the working position, it suffices for the user, on one hand, to press on the beam and, on the other hand, pull apart the tubular branches.

It is clear that, in the above-mentioned arrangement, the bag of the invention can only be placed in the working position where the ground is sufficiently soft to allow the lateral pegs of the support body to penetrate. Then again, according to the invention, one seeks to provide a bag able to be used on any terrain whatsoever, even hard, for example at the poolside.

To this end, and according to a preferred characteristic of the invention, the fixing means include two sockets respectively moveable along the lateral pegs of the support body and provided with retainiing legs able to be introduced from the outside into the guide sleeves of the frame so as to permit the support body, removed from the pocket, to rest on the ground and keep the bag in the upright position.

Conforming to this configuration, the support body, once removed from the pocket, then serves as a "base" for the bag and the suspension body in the working position and holding clothes.

As a result of the removable character of the fixing means, it is possible for the user to remove them from the bag and particularly from the pocket, and to use them indoors, as a "dumb waiter" in a manner totally independent from the bag and in particular from the pocket.

According to another characteristic of the invention, the bag includes a protective sheet folding inside the pocket in the resting position and unfolding over the suspension body in the working position to protect the clothing or other items which are hung there from the wind, bad weather, dust . . . This sheet can, moreover, play an aesthetic role allowing the camouflage of the "display" of clothing. It is particularly advantageous to provide it, at its lower half, with attachments allowing it to be fixed to the support body.

According to another characteristic of the invention, the bag is equipped, particularly on the surface opposite the pocket, with a flap folding in the resting position and able to be locked, in this position, by means of a locking mechanism.

This flap notably serving as a magazine holder in the resting position, is transformed, in the working position, into a shelf which must be sufficiently rigid to allow the user relaxing on a beach or beside a swimming pool to put on it various items such as suntan products, drinks, sunglasses . . .

In the resting position, locking means such as slide fasteners or press studs hold the flap.

Of course, the bag of the invention is, preferably, fitted, on its upper half, with standard closing means.

So that holiday-makers may leave their bags on the beach for a while, particularly to take their swim without risking the disappearance of the contents, the closing means of the bag are, according to another characteristic of the invention, linked to an alarm, particularly an audible alarm, co-operating with engaging means operable from outside to control the emission of an alarm signal, particularly of an audible signal in response to any attempt to open the closing means.

The characteristics of the bag of the invention will be described in more detail with reference to the accompanying drawings in which.

Figure 1:
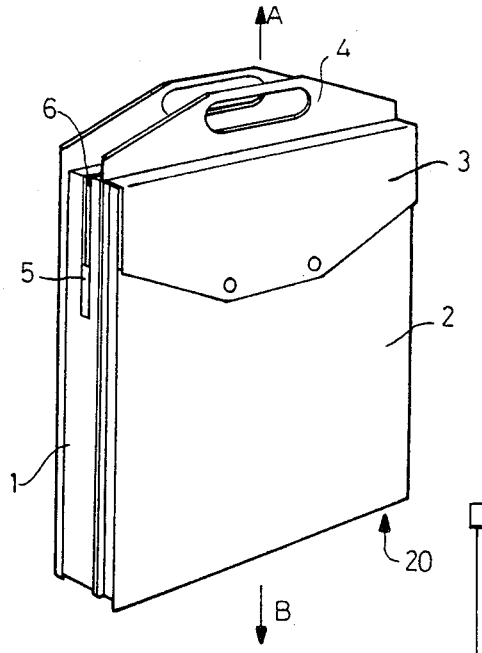
FIG. 1 is a perspective view of the bag in the resting position.

According to FIG. 1, the bag of the invention is made up of a bag 1 in any material, particularly fabric with an impermeable coating on its interior, which is fitted on one of its surfaces with a pocket 2 closed by a flap 3 and containing removable fixing means allowing the bag to be converted into a valet. Handles 4 allow the user to grasp the bag which can be fitted with other devices, such as for example a label holder 5 or closing means 6.

Figure 4:
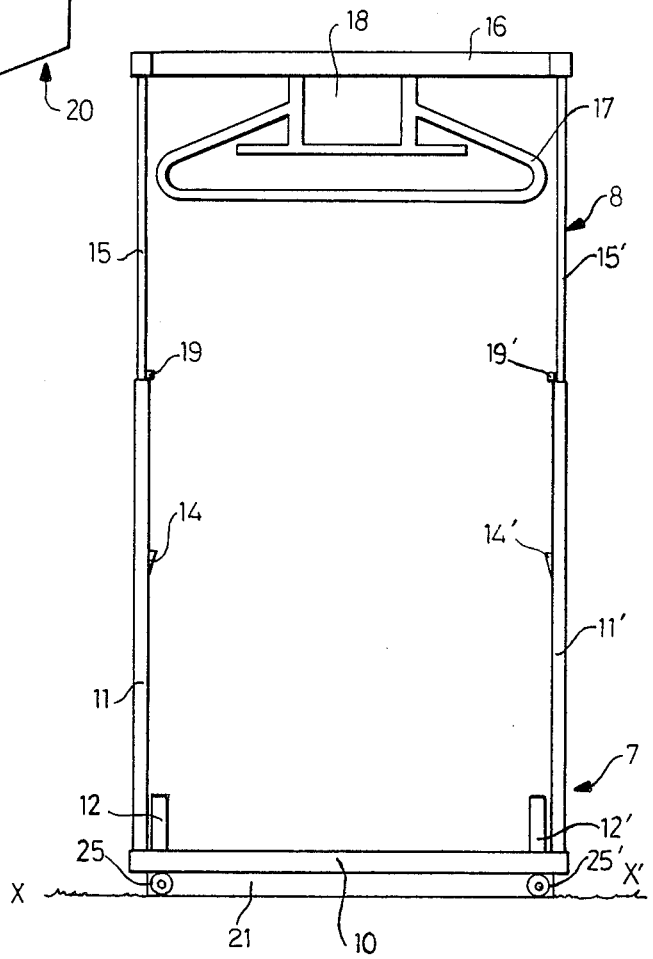
FIG. 4 shows the fixing means in the working position.
Figure 2:
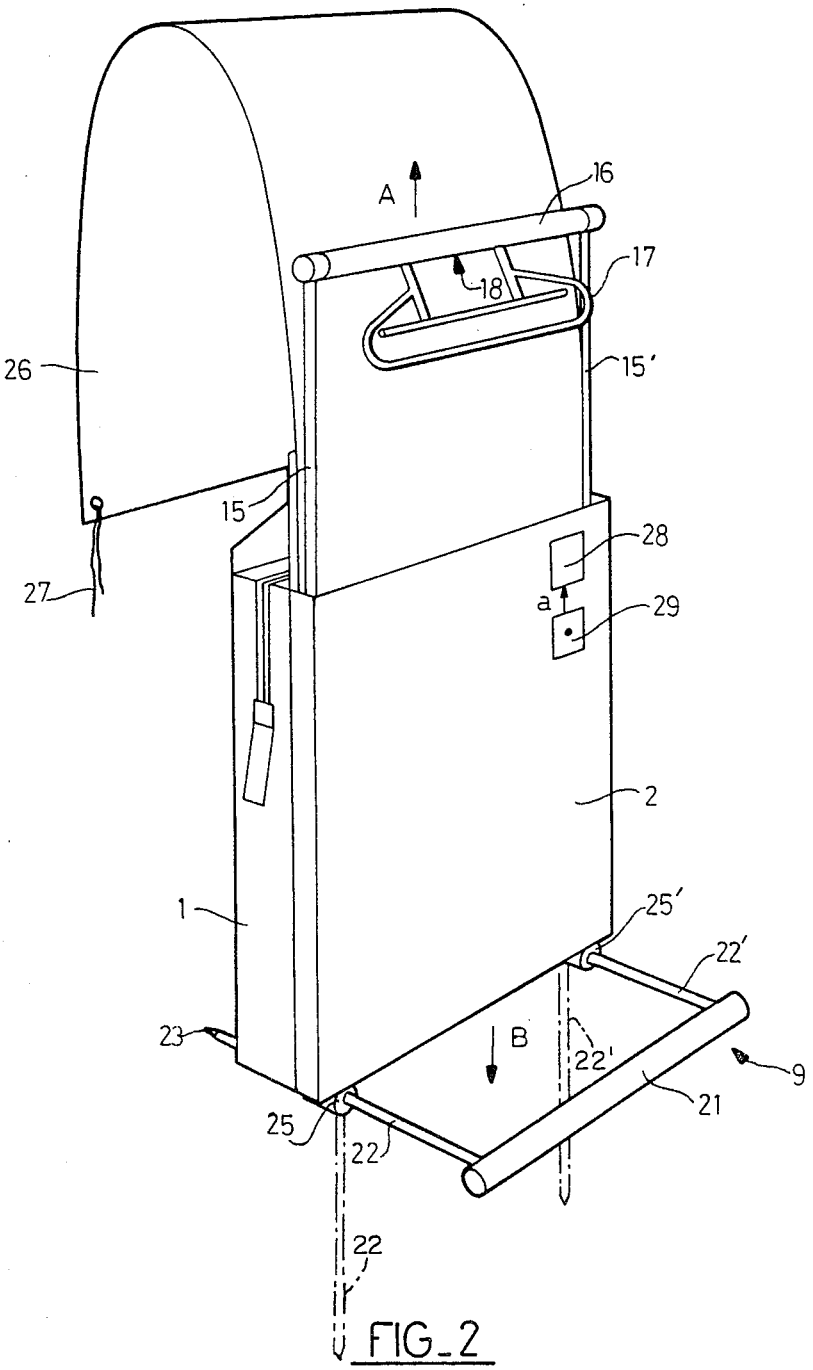
FIG. 2 is a perspective view of the bag in the working position.

The fixing means are moveable from a resting position in which they are fully enclosed within the pocket 2 (FIGS. 1 and 3) and a working position in which they project outwards on either side of it (FIGS. 2 and 4).

Figure 5:
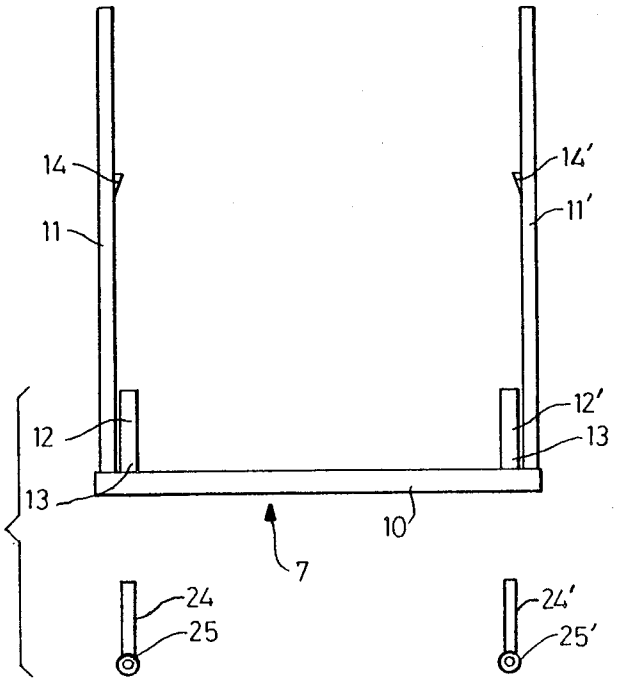
FIG. 5 shows the frame.

These means comprise a frame 7 shown in FIG. 5 which rests on the lower half 20 of the pocket 2 and co-operate with two moveable bodies in the shape of an inverted U, that is a telescopic suspension body 8 moveable upwards in the direction of arrow A (FIGS. 1 and 2) and a support body 9 displaceable downwards in the direction of arrow B.

According to FIG. 5, the frame 7 is made up of a main bar 10 whose extremities carry perpendicular two tubular branches 11 and 11' which serve as guide sheaths for the suspension body 8 as will be described in more detail hereinafter.

The main bar 10 co-operates moreover with the guide sleeves 12, 12' mounted in the immediate vicinity of the tubular branches 11 and 11' parallel to them, and defining in their interiors through-bores 13, 13' extending along their whole lengths, and extending through the walls of the bar 10. Lugs forming abutments 14, 14' are also foreseen to keep the support body 9 in the pocket 2 when the bag is in the resting position.

Figure 3:
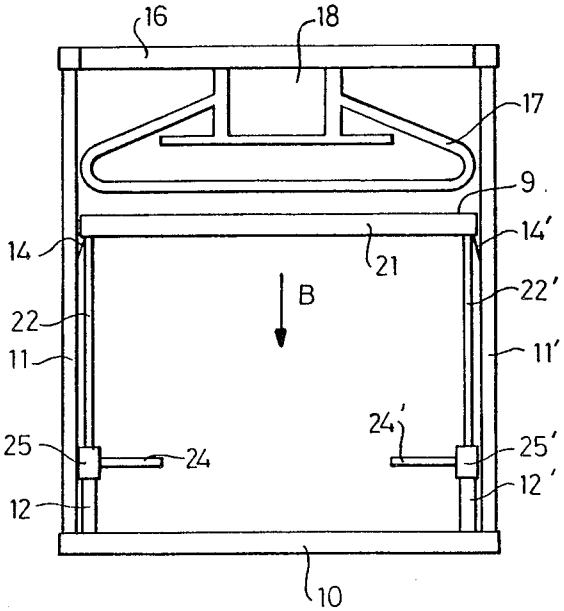
FIG. 3 shows the fixing means in the resting position.

According to FIGS. 3 and 4, the suspension body 8 is made up from two lateral arms 15 and 15' moveable telescopically in the branches 11, 11' forming sheaths of the frame 7, as well as a central crossbar 16 whose centre carries a coat hanger 17 articulated in its upper half 18 (FIG. 2) so as to facilitate the placing and holding of the clothes.

Pawls 19, 19' mounted on the lower ends of the lateral arms 15 and 15' allow the body 8 to be kept and locked in the working position as shown in FIG. 4, arms 15, 15' projecting outwards through an opening not shown to come to a stop against the upper end of the branches 11 and 11' of the frame 7. One could equally, without departing from the scope of the invention, provide for this purpose an opening at the upper end of the branches 11 and 11'. This configuration would have the advantage of avoiding all involuntary separations of the frame 7 from the body 8.

Moreover, and according to FIGS. 3 and 4, the support body 9 is made up of a central beam 21 as well as two lateral pegs 22 and 22' ending in points 23, 23' (shown in dotted lines in FIG. 4), and able to penetrate inside the perforations 13, 13' of the guide sleeves 12, 12' and inside the corresponding apertures, not shown in the figures, provided for this purpose in the lower half 20 of the pocket 2 so as to be able to be driven into the ground in the position shown in dotted lines in FIG. 2 to allow the bag to stand upright on the ground x, x'.

As shown in FIG. 3, the lugs 14, 14' of the tubular branches 11, 11' allow the support body 9 to remain in the resting position inside the pocket 2 serving as abutments for its central beam 21; from this position, to bring the body 9 into the working position as shown in FIG. 4, it suffices for the user to press down upon the beam 21 with his hand in the direction shown by arrow B, and at the same time to pull apart the tubular branches 11 and 11' in order to disengage the body 9 from the lugs 14, 14'.

Furthermore, two sockets 25, 25' are moveable respectively in translation along the lateral pegs 22, 22' of the support body 9 to which they are attached particularly by means of cords not shown in the figure; these sockets are fitted with lateral retaining legs 24, 24' able to be introduced from the outside into the perforations 13, 13' of the guide sleeves 12, 12' of the frame 7 as shown in solid lines in FIG. 2 to allow the body 9 to make a base so that the bag may be placed in an upright position in cases where the ground is too hard for the points 23, 23' to be driven in, as shown in the dotted lines in FIG. 2.

According to FIG. 2, the pocket 2 contains in addition a folding protective sheet 26 fitted with ties 27 able to be fixed to the pegs 22, 22' of the body 9 so as to protect clothes and other items placed on the hanger 17.

The above-mentioned bag could of course be equipped with other devices without departing from the scope of the invention, particularly with a folding flap fixed to the surface opposite the pocket.

According to FIG. 2, in order that the above-mentioned bag should be fully satisfactory and in particular allow the user to leave it for a time without risking the disappearance of the contents of the bag 1, the bag is fitted with an audible alarm 28 shown schematically, connected to the closing means 6 of the bag 1 and cooperating with engaging means 29, particularly a pushbutton able to be activated from the outside to control an emission from the mechanism 28 of an audible alarm signal in response to any attempt to open the closing means 6.

It would equally be possible to provide alarm mechanisms of the type currently used notably in automobiles and triggerable at any attempt to steal the bag as a whole.

Moreover, to reduce the volume of the bag of the invention, the arms 15, 15' of the body 8 and/or the branches 11, 11' of the frame 7 can be made from telescopically sliding elements.

We claim:

1. A convertible valet bag, characterized in that it is made from a generally rectangular bag opened at the top and fitted, at said top, with holding means, as well as with a frame comprising a generally horizontal base having on opposite ends a first and second, generally vertical, hollow branch and a first and second, generally vertical, hollow guide sleeve, said frame cooperating with a first and second movable body, wherein the first movable body is a suspension body slidably mounted in the generally vertical branches and movable between a resting position inside the bag and a working position in which it serves as a support on which to hang articles, and wherein the second movable body is a support body slidably mounted in the generally vertical guide sleeves and movable between a resting position inside the bag and a working position in which it allows the bag to rest in a generally upright position.

2. A bag according to claim 1, characterized in that the bag comprises a pocket and that while in the resting position, the first and second movable bodies are completely retracted inside the pocket.

3. A bag according to claim 1, characterized in that the bag comprises a pocket and that the base of the frame rests on the bottom of the pocket, the hollow branches are adjacent the side walls of the pocket, the suspension body is in the shape of an inverted U comprising a first and second side arm slidably mounted in the first and second branches of the frame, respectively, and a cross bar carrying a coat hanger, wherein the first and second side arms are at opposite ends of the crossbar and are generally perpendicular to the longitudinal axis of the crossbar, and the support body is in the shape of an inverted U comprising a central beam, and a first and second lateral peg, each lateral peg being slidably mounted in the first and second guide sleeves, each lateral peg ending in points, and each lateral peg being dimensioned to project outwards through corresponding openings provided at the base of the frame and the base of the pocket for the purpose of driving at least a portion of the first and second lateral pegs into the ground by exerting a generally downward pressure on the central beam.

4. A bag according to claim 3, characterized in that each of the branches of the frame comprise a generally perpendicular lug mounted on the external periphery of each branch, wherein the distance between the upper portion of the lug and the base of the frame is greater than the length of the lateral pegs of the support body, said lugs forming an abutment for the central beam of the support body to keep the support body inside the pocket in the resting position.

5. A bag according to claim 3 characterized in that each of the side arms of the suspension body cooperate with a generally perpendicular, retractable, first and second pawl comprising an element resiliently braced inside the first and second side arms, respectively, for holding the suspension body in the working position by extending in a generally horizontal direction beyond the external periphery of the first and second side arms and beyond the sidewalls of the first and second frame branches.

6. A bag according to claim 1 characterized in that the support body is in the shape of an inverted U and comprises a central beam, a first and second lateral peg, and a first and second socket, wherein the first and second sockets are located on the first and second lateral pegs, respectively, wherein each of the first and second sockets are movable in translation along their respective lateral peg and wherein each of the first and second sockets are fitted with a retaining leg, wherein each retaining leg is generally perpendicular to the longitudinal axis of its socket, respectively, and wherein each retaining leg is dimensioned to be introduced from the outside of the bag, through corresponding openings provided for that purpose in the bottom portion of the bag and the base of the frame, into the first and second guide sleeve to keep the bag in a generally upright position.

7. A bag according to claim 2 characterized in that it includes a protective sheet which, when in a resting position, can be folded inside the pocket and, when in a working position, can be unfolded above the suspension body, which is in the working position, to protect articles which hang from the suspension body.

8. A bag according to claim 1, characterized in that the bag is fitted with a flap which folds down when in the resting position and comprises a locking mechanism.

9. A bag according to claim 1 characterized in that the bag is fitted, on its upper half, with closing means connected to an alarm means cooperating with engaging means , wherein the engaging means which can be activated to control the emission of an alarm signal in response to any attempt to open the closing means without first disengaging the alarm means from the engaging means.

* * * * *